US009468789B2

(12) United States Patent
Williams

(10) Patent No.: US 9,468,789 B2
(45) Date of Patent: Oct. 18, 2016

(54) RESISTANCE BAND HAVING HAND ADAPTERS AND HANDLES

(71) Applicant: Ronald Williams, Draper, UT (US)

(72) Inventor: Ronald Williams, Draper, UT (US)

( * ) Notice: Subject to any disclaimer, the term of this patent is extended or adjusted under 35 U.S.C. 154(b) by 0 days.

(21) Appl. No.: 14/853,907

(22) Filed: Sep. 14, 2015

(65) Prior Publication Data

US 2016/0001120 A1 Jan. 7, 2016

Related U.S. Application Data

(63) Continuation-in-part of application No. 14/523,706, filed on Oct. 24, 2014.

(60) Provisional application No. 61/895,305, filed on Oct. 24, 2013.

(51) Int. Cl.

*A63B 21/02* (2006.01)
*A63B 21/055* (2006.01)
*A63B 21/00* (2006.01)

(52) U.S. Cl.

CPC ..... *A63B 21/0552* (2013.01); *A63B 21/00043* (2013.01); *A63B 21/0557* (2013.01); *A63B 21/4019* (2015.10); *A63B 21/4035* (2015.10); *A63B 21/4043* (2015.10)

(58) Field of Classification Search

CPC ..... A63B 21/055; A63B 21/0555; A63B 21/0557; A63B 21/4014; A63B 21/4043; A63B 23/12; A63B 23/1209; A63B 23/1236; A63B 69/004; A63B 69/34; A63B 21/0552; A63B 21/04; A63B 21/0407; A63B 21/4019

See application file for complete search history.

(56) References Cited

U.S. PATENT DOCUMENTS 5,433,688 A * 7/1995 Davies ..... A63B 21/0552 482/124
6,595,900 B1 * 7/2003 Cook ..... A63B 5/20 482/126
6,629,912 B2 * 10/2003 Downs ..... A63B 21/0552 482/124
7,344,485 B1 * 3/2008 Simpson ..... A63B 21/0004 482/121
8,602,952 B1 * 12/2013 Cruz ..... A63B 21/04 482/121
9,248,331 B1 * 2/2016 Collier ..... A63B 21/0555
2005/0059537 A1 * 3/2005 Hull ..... A63B 21/0004 482/124
2007/0207904 A1 * 9/2007 Wu ..... A63B 21/0004 482/126
2009/0215593 A1 * 8/2009 Ligrano ..... A63B 21/00043 482/124
2011/0224055 A1 * 9/2011 Kassel ..... A63B 21/0552 482/121
2013/0053225 A1 * 2/2013 Meyer ..... A63B 21/0552 482/124
2013/0143724 A1 * 6/2013 Demeo ..... A63B 21/00185 482/131
2013/0203567 A1 * 8/2013 Thomas ..... A63B 21/4025 482/124
2013/0331242 A1 * 12/2013 Wilson ..... A63B 21/0004 482/126
2013/0333097 A1 * 12/2013 Cranke ..... A63B 21/0557 2/300
2014/0051558 A1 * 2/2014 Flentye ..... A63B 21/0552 482/139
2014/0228180 A1 * 8/2014 Walker ..... A63B 5/20 482/82

* cited by examiner

*Primary Examiner* — Oren Ginsberg
*Assistant Examiner* — Nyca T Nguyen
(74) *Attorney, Agent, or Firm* — David R. Conklin; Kirton McConkie

(57) ABSTRACT

The present invention relates to exercise equipment and more particularly to a resistance band having a pair hand adapters, a pair of handles, and an extension interposed between each hand adapter and handle. The present invention farther relates to a hand adapter having a plurality of finger loops that are configured to contact the back surface of fingers of a user's hand, and the surface of the hand adapter to which the plurality of finger loops is attached is configured to contact the palm surface of the user's hand.

11 Claims, 7 Drawing Sheets

RESISTANCE BAND HAVING HAND ADAPTERS AND HANDLES

RELATED APPLICATIONS

This application is a continuation-in-part of U.S. patent application Ser. No. 14/523,706, filed Oct. 24, 2014 and titled HAND ADAPTER FOR RESISTANCE BAND, which claims priority to U.S. Provisional application No. 61/895,305, filed Oct. 24, 2013 and titled HAND ADAPTER FOR RESISTANCE BAND, both of which are incorporated herein in their entirety.

TECHNICAL FIELD

The present invention relates to exercise equipment. More particularly, the present invention relates to an exercise device that is used to increase resistance to a user's anterior deltoid (shoulder), triceps, and chest muscles during exercise movements. The exercise device comprises a pair of hand adapters which resemble fingerless, backless gloves, each hand adapter having a pad comprising a plurality of open-ended sheaths or finger loops. The pad protects the palm of the hand while the finger loops receive the user's second, third, fourth and fifth phalanges. The hand adapters are interconnected via a resistance band that attaches to the pad of each adapter. The design and features of the instant invention provide the wearer with an unobstructed grip of an exercise machine or a workout surface. The design and features of the instant invention provide the user with decreased wrist and thumb extension torque and increased wrist and thumb control by transmitting the resistive forces of the resistance band to the user's wrist and forearm in a compressive manner via the user's metacarpals.

BACKGROUND

Resistance training or weight lifting is a common type of strength training for developing the strength and size of skeletal muscles. Weight and resistance training uses the weight force of gravity to oppose the force generated by muscle through concentric or eccentric contraction. Weight and resistance training uses a variety of specialized equipment to target specific muscle groups and types of movement.

As a general rule, muscle development occurs when resistance is added to a muscle movement. Resistance may be added by various means. In a simplest example, body weight adds resistance to a person's muscles and leads to muscle development as the person's muscle groups undergoes movement. A person's body weight provides a base amount of resistance that requires a minimum level of muscle mass to facilitate the person's muscle movements. Muscle development may occur when either the resistance increases, or when the amount of muscle movement increases. In both instances, the person's muscles will become fatigued, thereby requiring that the muscles undergo development to accommodate for the increased activity and/or resistance.

The objective in weight training is to maximize muscle development by increasing the resistance and/or muscle movement experienced by the individual. Exercise machines have been developed with the specific goal in mind of increasing resistance to, and repetition of muscle movement. Exercise movements have also been developed which are designed to maximize a person's body weight to provide general or isolated resistance to one or more muscles or muscle groups. For example, pushups, squats, lunges, and sit ups are examples of exercise movements that coordinate resistance and muscle movement to maximize muscle development.

In some instances, resistance is added to muscle movement using free-weights. A free-weight can be classified as any object or device having a mass that can be moved freely in three-dimensional space. Examples of common free-weights include dumbbells, barbells, high/low or adjustable pulley systems, lat pull-down and low row devices, medicine balls, kettle bells, ankle weights, and the human body. In reality, any object that is free to move in three-dimensional space that is not fixed to any specific set of axis can be considered a free-weight.

Weight training may also be performed using an exercise machine. Unlike free-weights, an exercise machine is designed to limit the biomechanical motion of a portion of a user's body to one or two-dimensions. In this way, the exercise machine may focus the resistance and efforts of the user to an isolated muscle, or group of muscles.

Exercise machines use gravity, friction, tension, compression, and/or hydraulic forces to provide isolated resistance to the user. Exercise machines further provide optimized biomechanical movement and resistance for the user's body by incorporating various combinations of cables, cams, springs, elastomeric bands, hydraulic cylinders, levers, and pulleys into the machine's design. Exercise machines are thus specifically designed to provide exact, repeatable biomechanical motions that are calculated to optimize desired muscular development. In theory, any user that performs weight training on an exercise machine will achieve the muscular development for which the exercise machine was specifically designed.

In some instances, it may be desirable to add increased resistance to an exercise movement or an exercise machine. Free-weights generally come in a variety of graduated units, such that a user may increase resistance by simply adding an additional unit, or swapping one unit for another unit having increased mass. Exercise machines are similarly configured to permit a user to easily add or remove resistance, as desired.

Resistance bands are also useful in adding resistance to an exercise movement. A resistance band generally comprises a sheet or tube structure comprising a resilient or elastic material, such as rubber or an elastomeric polymer. A first end of the resistance band may be attached to a part of the user's body, with a second end of the resistance band being secured to a fixed surface. Resistive forces from the resistance band are imparted to the user's movement as a distance between the first end and the second end of the band increases.

For example, a user may hold the first end of the band in his hand while the second end of the band is held against the floor by the user's foot. In other instances, the first and second ends of the band may be held in user's hands while a middle section of the band is held against the floor by the user's foot. Further still, in some instances the first and second ends of the band are held in the user's hands while the middle portion of the band is stretched across the user's back. The user's movement generally lengthens the resistance band, thereby increasing the resistive forces experienced by the user during the movement.

Generally, a user wraps the ends of the resistance band around their hands prior to grabbing the free-weight or exercise machine, thus holding the band and the exercise equipment in the palm of their hand. In some instances, the ends of the elastic band are formed into loops or attached to a handle or strap that the user places in their palm to hold with the free-weight or exercise machine. The presence of the resistance band or handle in the user's palm necessarily interferes with the user's grip during the weight training exercise. Further, placement of the band, loop, strap or handle in the user's palm causes increased wrist, thumb, and/or palm extension torque as resistive forces increase during the exercise movement. This results in over-extension of the user's wrist, thumb, and/or palm which may cause discomfort to the user, as well as promote improper biomechanical motion.

Thus, while systems and devices currently exist for adding resistance to an exercise movement, challenges still exist. Accordingly, there is a need in the art for an improved device that overcomes the current challenges. Such a device is disclosed herein.

BRIEF SUMMARY OF THE INVENTION

The present invention relates to exercise equipment. More particularly, the present invention relates to an exercise device that is used to increase resistance to a user's chest, shoulder, and tricep muscles during exercise movements. The exercise device comprises a pair of hand adapters which resemble fingerless, backless gloves, each hand adapter having a pad comprising a plurality of open-ended sheaths or finger loops. The pad protects the palm of the hand while the finger loops receive the user's second, third, fourth and fifth phalanges. The hand adapters are interconnected via a resistance band that attaches to the pad of each adapter. The design and features of the instant invention provide the wearer with an unobstructed grip of an exercise machine or a workout surface. The design and features of the instant invention provide the user with decreased wrist and thumb extension torque and increased wrist control by transmitting the resistive forces of the resistance band to the user's wrist and forearm in a compressive manner via the user's metacarpals.

Some implementations of the present invention provide a resistance chest strap device that goes around the back, which includes a resistance band having two ends, each end being selectively attached to a respective hand adapter. The hand adapters generally resemble a fingerless, backless glove, wherein the hand adapter comprises a pad having a top surface, a bottom surface, a proximal end and a distal end. The pad comprises one or more finger loops that are coupled to the distal end. The finger loops are capable of receiving the proximal phalanges of the user's hand. The pad further comprises a mounting block or attachment loop that is coupled to the proximal end and is configured to receive and/or retain an end of the resistance band. Thus, the hand adapters are interconnected via the resistance band.

Some implementations of the present invention further provide an attachment means that is capable of assisting the user in donning and removing the hand adapters in spite of the resistive forces exerted by the resistance band. The attachment means may include any connector or fastener that may be easily established and removed, as desired.

Some implementations of the invention further comprise a resistance band having a pair of hand adapters, and further comprising a pair of handles, wherein each handle is located at a terminal end of the resistance band, and the hand adapters are positioned between the pair of handles. A user may thus select between the hand adapters and the handles when using the resistance band, thereby increasing the utility of the resistance band exercise device.

DESCRIPTION OF THE DRAWINGS

It will be appreciated by those of ordinary skill in the art that the various drawings are for illustrative purposes only. The nature of the present invention, as well as other embodiments of the present invention, may be more clearly understood by reference to the following detailed description of the invention, to the appended claims, and to the several drawings.

DETAILED DESCRIPTION

The present invention relates to exercise equipment. More particularly, the present invention relates to an exercise device that is used to increase resistance to a user's chest, shoulder, and triceps muscles during exercise movements. The exercise device comprises a pair of hand adapters which resemble fingerless backless gloves, each hand adapter having a pad comprising a plurality of open-ended sheaths or finger loops. The pad covers and/or protects the palm of the hand while the finger loops receive the user's fingers. The hand adapters are interconnected via a resistance band that attaches to the pad of each adapter. The design and features of the instant invention provide the wearer with an unobstructed grip of an exercise machine or a workout surface. The design and features of the instant invention provide the user with decreased wrist and thumb extension torque and increased wrist control by transmitting the resistive forces of the resistance band to the user's wrist and forearm in a compressive manner via the user's metacarpals.

As used herein, the terms "fingerless" and "fingerless glove" describe a glove-like structure having open-ended sheaths or finger loops for receiving the second, third, fourth, and fifth phalanges of a user's hand. In some instances the glove-like structure is backless, wherein the open-ended sheaths or finger loops are attached to a pad that contacts the user's palm.

Figure 1:
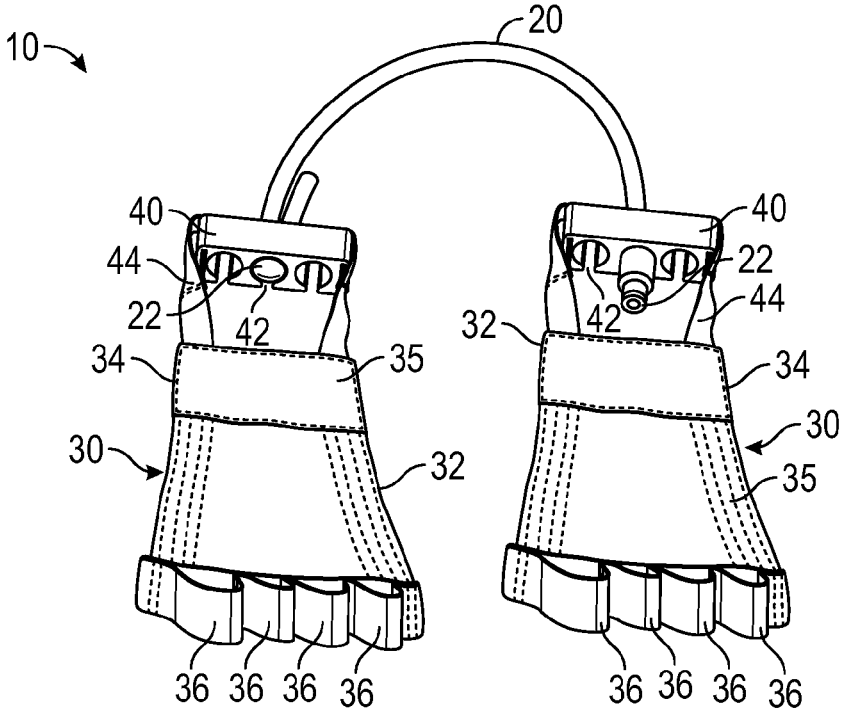
FIG. 1 is a perspective view of a resistance back strap device in accordance with a representative embodiment of the present invention.

Referring now to FIG. 1, a resistance back strap device 10 is shown. Device 10 comprises a resistance band or strap 20 that interconnects two hand adapters 30. Resistance band 20 comprises an elastic material, such as surgical tubing. Band 20 may also include rubber sheeting, tubing, straps, matrices, cord, and other similarly functioning structures and materials. In some instances, band 20 comprises an elastomeric polymer material.

Band 20 comprises terminal ends 22 that are selectively attached to hand adapters 30. Generally, a first terminal end of band 20 is attached to a first hand adapter, and a second terminal end of band 20 is attached to a second hand adapter, such that band 20 interconnects the two hand adapters 30. In some instances, band 20 is indirectly coupled to hand adapters 30 via a mounting block 40. Mounting block 40 generally comprises a rigid or semi-rigid material having a receptacle 42 for receiving terminal end 22. In some instances, receptacle 42 comprises tapered sidewalls, wherein terminal end 22 is wedged into receptacle 42 as terminal end 22 is seated within receptacle 42. In other instances, band 20 is directly coupled to hand adapter 30 via a loop of flexible material or other connection that directly forms a surface of hand adapter 30, as shown and discussed in connection with FIGS. 5A and 5B, below.

For some embodiments, mounting block 40 attaches to the base 34 of hand adapter 30 via one or more non-elastic straps 44, such as nylon webbing. Base 34 comprises a portion of the pad 32 of hand adapter 30. When worn by a user, base 34 is generally aligned with the user's wrist and thumb pad. Pad 32 is configured to cover the user's palm and provide a protective and stable barrier between the user's hand and a piece of exercise equipment. In some instances, pad 32 comprises a tapered shape that resembles the shape of a user's hand, wherein the portion of pad 32 that is aligned with the user's knuckles is wider than the portion of pad 32 that is aligned with the user's wrist. Thus, the dimensions of pad 32 are configured to prevent or minimize excess material from overhanging the user's palm.

Pad 32 generally comprises a flexible, non-elastic material, such as nylon, suede, leather, webbing, or other materials having equally compatible properties. In some instances, pad 32 comprises a non-slip material or coating to improve the user's grip. In some instances, pad 32 further comprises padding material. Pad 32 may also comprise a moisture wicking material or coating. In some instances, pad 32 further comprises a heat absorbing material or coating. Pad 32 may further comprise an antibacterial coating.

The top surface 35 of pad 32 further comprises a plurality of finger loops 36 that are positioned opposite base 34. Finger loops 36 are configured to receive the second, third, fourth, and fifth phalanges of the user. Finger loops 36 may comprise any length and diameter. In some instance, finger loops 36 comprise a length that approximates the length of the user's proximal phalanges, for example from 0.75 inches to 1.5 inches. In other instances, finger loops 36 comprise a length that is less than the length of the user's proximal phalanges, for example less than 0.75 inches. The diameter of finger loops 36 is generally configured to permit easy insertion and removal of the user's fingers, while maintaining close contact between the pad and the user's palm. For example, in some instances finger loops 36 comprise a diameter from approximately 0.75 inches to approximately 1.5 inches.

Figure loops 36 generally comprise a non-elastic material, such as nylon webbing. In some instances, finger loops 36 comprise independent loops that are individually coupled to pad 32. In other instances, finger loops 36 comprise a single strap of material that is attached to pad 32 at various intervals to form loops. Hand adapters 30 may comprise various numbers and sets of finger loops to accommodate the use's phalanges. For example, in some instances each pad 32 comprises four finger loops, each finger loop being configured to receive a single finger. In other instances, each pad 32 comprises three finger loops, wherein two loops are configured to each receive a single finger, and a third loop is configured to receive two fingers. Further, in some instances each pad 32 comprises two finger loops, wherein each loop is configured to receive two fingers. Alternatively, in some instances one loop is configured to receive one finger, and the second loop is configured to receive three fingers. In a further embodiment, pad 32 may comprise a single loop configured to receive four fingers.

Figure 2:
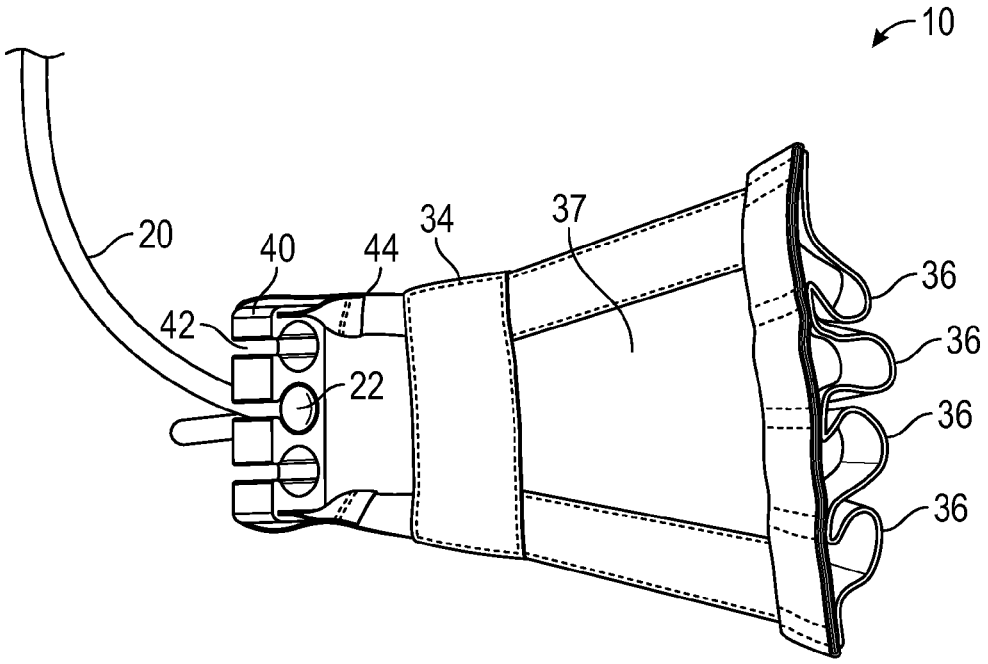
FIG. 2 is a detailed perspective view of a hand adapter of the resistance back strap device of claim 1, in accordance with a representative embodiment of the present invention.

Referring now to FIG. 2, pad 32 further comprises a bottom surface 37 that is generally planar and free from any projections or other surfaces that would interfere with the user's grip. Bottom surface 37 is positioned opposite of top surface 35 and is configured to directly contact a free-weight, exercise device, exercise machine, or floor surface when worn by the user. In some instances, bottom surface 37 comprises a slight texture or other feature to enhance the user's grip. Bottom surface 37 may further comprise a non-slip material or coating, as discussed previously.

Figure 3:
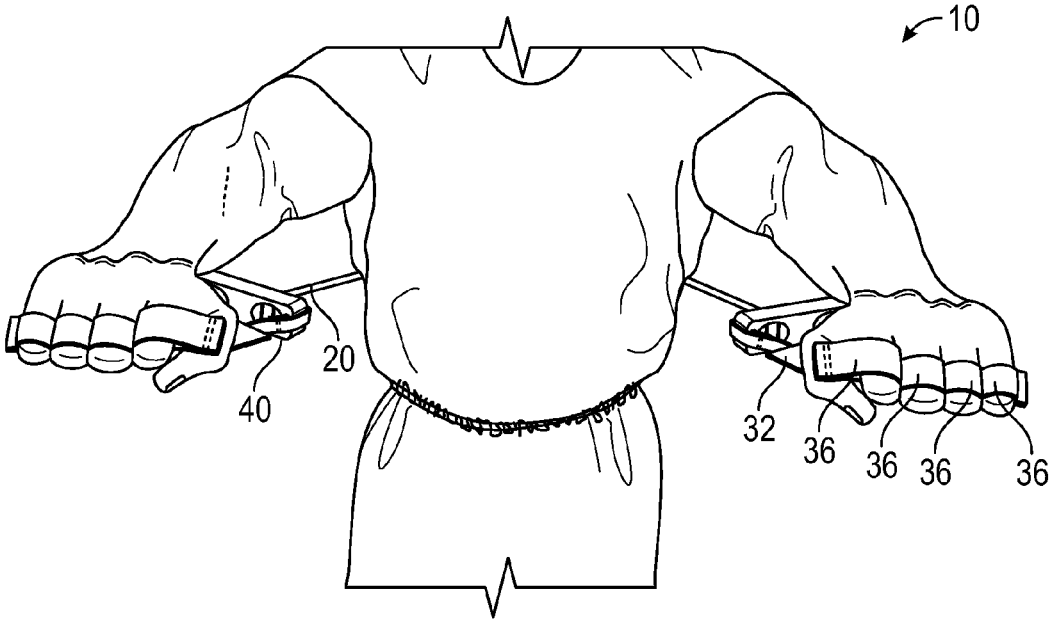
FIG. 3 is a perspective view of a resistance back strap device installed on a user in accordance with a representative embodiment of the present invention.

Referring now to FIG. 3, a middle portion of band 20 is supported across the user's back, thereby stretching band 20 when the user's arms are extended. One having skill in the art will appreciate that the middle portion of band 20 may be supported by other parts or areas of the user's body to add increased resistance to an exercise movement. Hand adapters 30 are secured to the user's hands via finger loops 36. Thus, pad 32, mounting block 40 and band 20 are oriented and/or positioned proximate to the anterior surface of the user's arms when the middle portion of band 20 is supported across the user's back. Further, band 20 and mounting block 40 generally extend outwardly from the center of the user's hand and wrist, and in close proximity to the user's hand and wrist, thereby greatly reducing and/or eliminating wrist extension torque, wrist flexion torque, wrist radial deviation torque, wrist ulnar deviation torque, wrist pronation torque, and wrist supination torque. Rather, the position of finger loops 36, pad 32, and mounting block 40 transfer the resistive forces of band 20 through the user's metacarpals, wrist, and forearm in a linear, compressive force which stabilizes the wrist throughout the exercise movement, thereby providing increased control and decreased likelihood of injury.

Figure 4A:
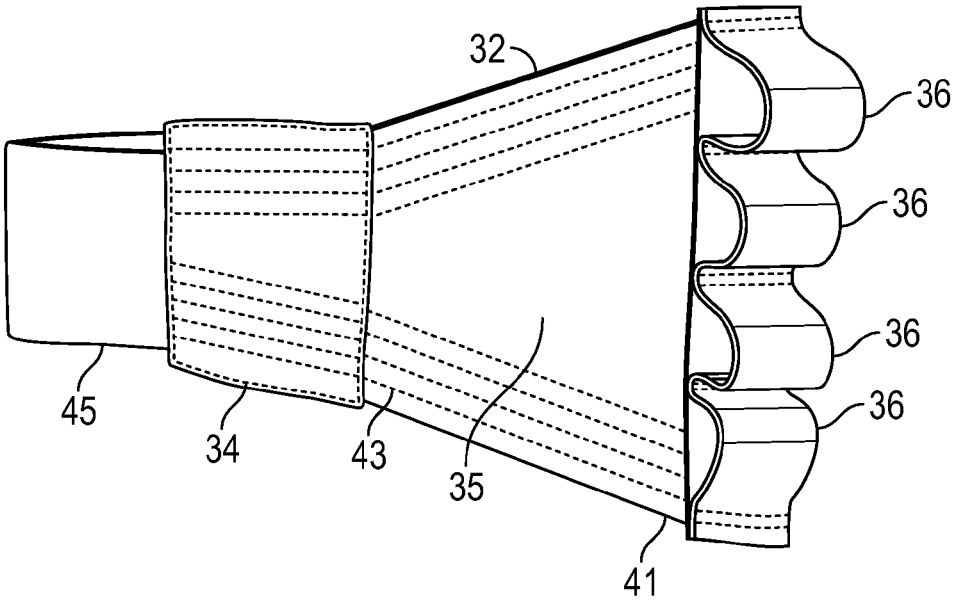
FIGS. 4A-4C show perspective top and bottom views of a hand adapter in accordance with a representative embodiment of the present invention.
Figure 4B:
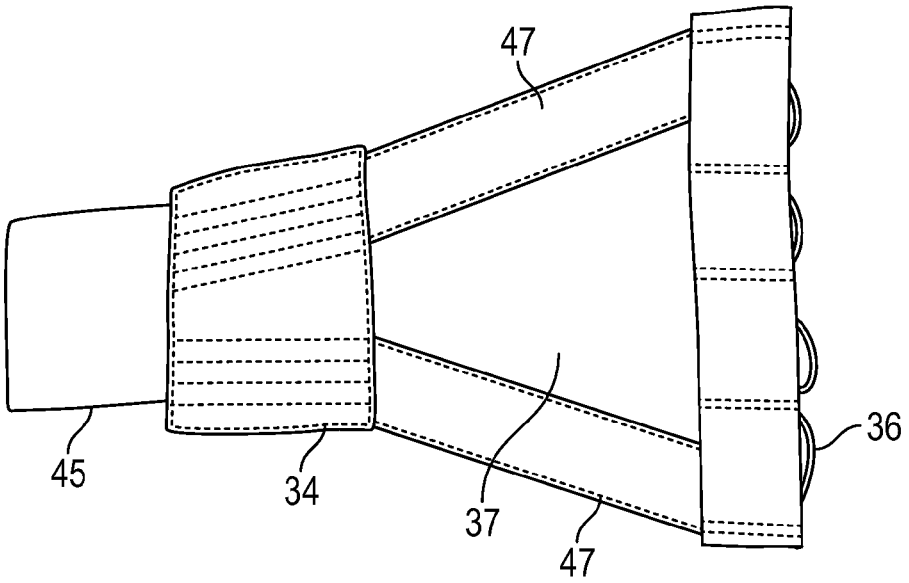

In some instances, pad 32 comprises a trapezoidal shape comprising a distal end 41 having a width that is greater than the width of a proximal end 43, as shown in FIGS. 4A and 4B. A width of distal end 41 is approximately equal to the width of the user's knuckles for the second through fifth phalanges. Distal end 41 further comprises finger loops 36. In some instances, pad 32 tapers inwardly from distal end 41 to proximal end 43, wherein the width of proximal end 43 is less than the width of the user's palm. As such, a portion of the user's palm overlaps one or more sides of proximal end 43, thereby permitting the overlapping portions of the user's palm to contact the exercise equipment or free-weight when wearing hand adapter 30. The overlapping portions of the user's hand may therefore be utilized in securely gripping the exercise equipment.

Figure 4C:
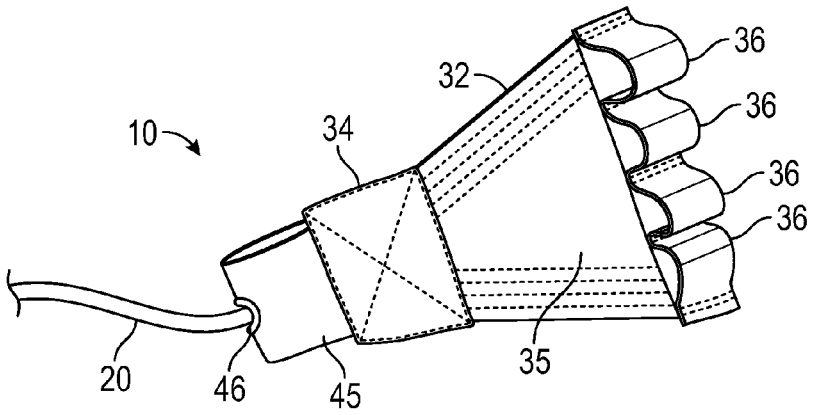
Figure 4D:
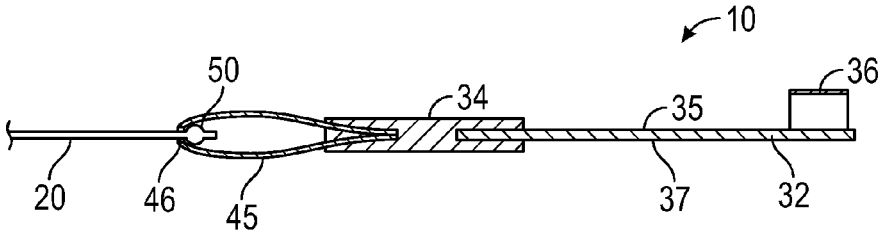
FIG. 4D shows a cross-section side view of a hand adapter in accordance with a representative embodiment of the present invention.

Proximal end 43 further comprises a mounting block comprising an attachment loop 45 that is secured to base 34. Generally, attachment loop 45 comprises a flexible, non-elastic material, such as nylon webbing. Band 20 is selectively coupled to pad 32 via attachment loop 45. In some instances, an end portion of band 20 is inserted through an opening or grommet 46 of attachment loop 45 and secured via a knot 50 or other similar structure, as shown in FIGS. 4C and 4D. In other instances, band 20 is coupled to attachment loop 45 via an attachment adapter, such as a hoop, a link, a clip, or other fastener (not shown). In some instances, band 20 is coupled to attachment loop 45 in a secure, yet easily manipulated manner, thereby permitting quick and easy attachment and removal of band 20 from pad 32.

As discussed previously, pad 32 generally comprises a non-elastic, yet flexible material. However, in some instances pad 32 comprises a material that may undergo stretching or slight deformation due to the resistive forces of band 20. Thus, in some embodiments pad 32 further comprises a boarder 47 of non-elastic, yet flexible material, such as nylon webbing. Boarder 47 is secured to pad 32 via reinforced stitching. Therefore, pad 32 may comprise a flexible, elastic or stretchable material which maintains its shape due to boarder 47.

Some embodiments of the present invention further comprise a feature to assist the user in donning and removing the hand adapters. Those skilled in the present art will appreciate that the compressive forces between the user's fingers and finger loops 36, as applied by band 20, may make it difficult to remove the user's fingers from the loops 36. Similarly, it may be difficult for the user to simultaneously overcome the resistive forces of band 20 while attempting to place the user's fingers in the finger loops 36. Therefore, some embodiments of the present invention comprise a means for selectively coupling the first and second hand adapters, as shown in FIGS. 5-6B.

Figure 5:
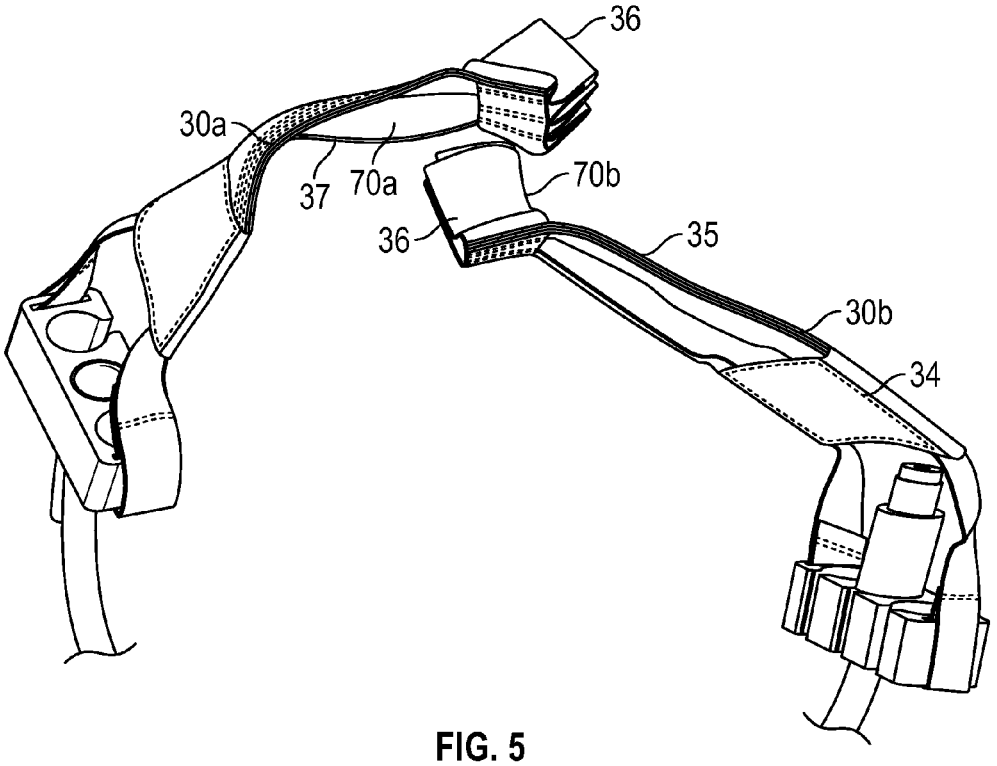
FIG. 5 shows a perspective side view of two hand adapters and demonstrates compatible surfaces for attachment means in accordance with a representative embodiment of the present invention.

Referring now to FIG. 5, a first hand adapter 30*a* may include a first attachment means 70*a* comprising a portion of bottom surface 37. Second hand adapter 30*b* may further include a second attachment means 70*b* comprising a portion of top surface 35 that is exposed when installed on the user's hand. For example, in some instances second attachment means 70*b* comprises an outer surface of finger loops 36. First and second attachment means 70*a* and 70*b* are generally compatible such that the attachment means are designed to selectively attach and detach from one another. For example, in some embodiments attachment means 70 comprises a hook and loop fastener, wherein the first attachment means 70*a* is a hook strip and the second attachment means 70*b* is a loop strip. In other embodiments, first attachment means 70*a* comprises clip and second attachment means 70*b* comprises a clip catch. Further, in some embodiments first attachment means 70*a* comprises a cleat and second attachment means 70*b* comprises a hook. Further still, in some instances attachment means 70 comprises a magnetic connection.

Figure 6A:
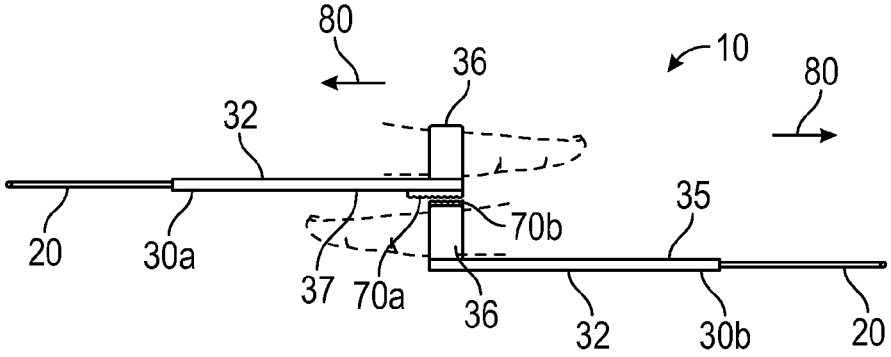
FIGS. 6A and 6B show a resistance back strap device installed on a user, the hand adapters of the device being selected interconnected via attachment means in accordance with a representative embodiment of the present invention.
Figure 6B:
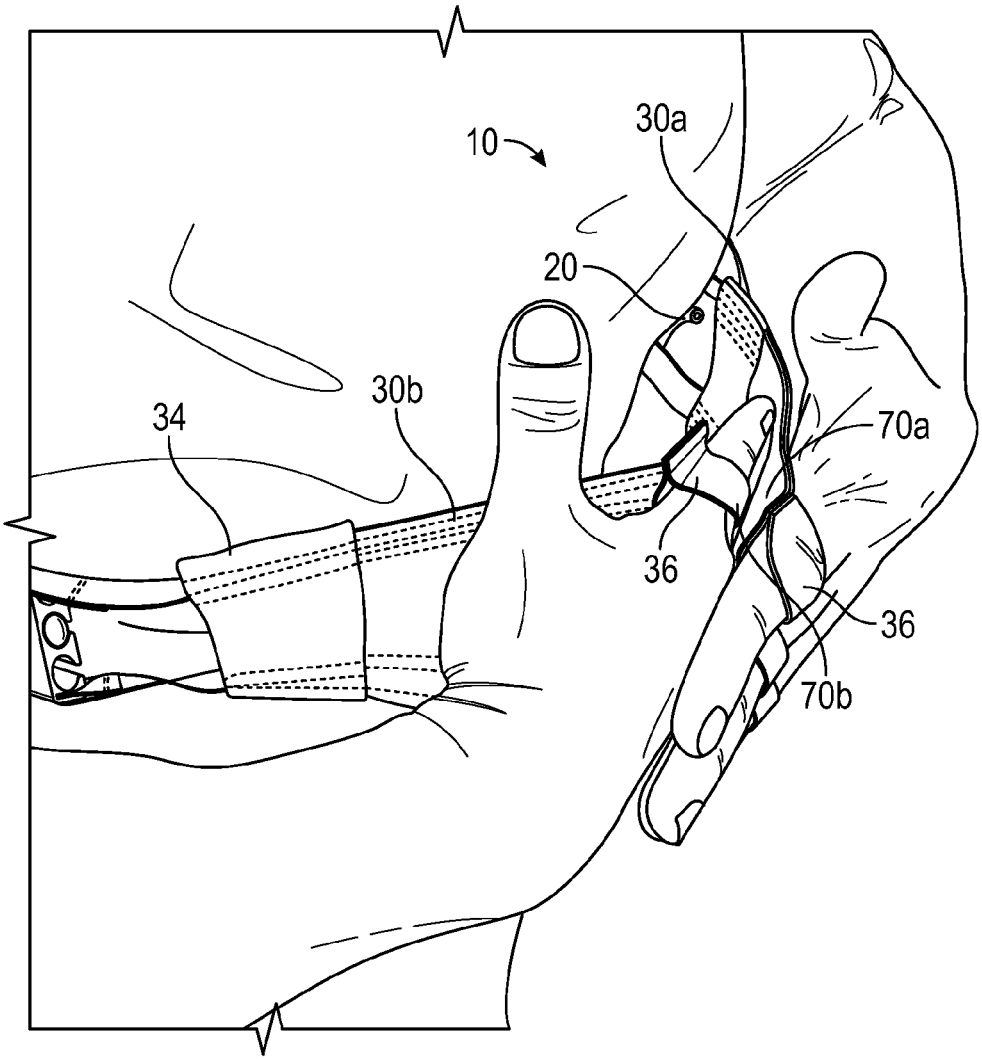

The locations of first and second attachment means may vary based upon the design of pad 32 and placement of finger loops 36. In one embodiments, a hook and loop connection is provided between opposite surfaces of pads 32 (i.e., top surface 35 and bottom surface 37), as shown in FIGS. 6A and 6B. In particular, a loop strip 70*a* is provided on the bottom surface 37 of first hand adapter 30*a*, and a hook strip 70*b* is provided on the outer surface of one or more of finger loops 36 of second hand adapter 30*b*. The locations of hook and loop strips 70*a* and 70*b* may be reversed, as desired. In this embodiment, the attachment means 70 of first and second hand adapters 30*a* and 30*b* are coupled by interfacing the opposing surfaces across the user's abdomen, as shown in FIG. 6B. The resistive forces 80 of band 20 pull against the shear strength of the hook and loop connection, thereby maintaining the connection. Once the connection is secured, the user may pull his fingers from finger loops 36. In some instances, the interconnected hand adapters 30*a* and 30*b* are stored on the user's abdomen between exercise movements or repetitions. The connection between the hand adapters is maintained until the user peals the outer hand adapter 30*a* away from the inner hand adapter 30*b*.

Attachment means 70 may comprise any portion of hand adapter 30. For example, in some instances first and second attachment means 70*a* and 70*b* are placed on like surfaces of pads 32 (i.e., both on bottom surfaces 37, or both on top surfaces 35). If the attachment means 70*a* and 70*b* are placed on the bottom surfaces 37, the user would couple the attachment means by interfacing the two bottom surfaces 37 and establishing contact between the two attachment means. If attachment means 70 are placed on like surfaces, the resistive forces 80 of band 20 may partially or completely undo the connection. According, for these embodiments attachment means 70 may be selected to either compensate for these types of pull-apart forces, or be sufficiently robust to withstand these forces.

In some instances, attachment means 70 may be utilized to assist the user in donning the resistance back strap device 10. For example, a user may first position band 20 on the user's back while holding the hand adapters in the user's hands. The user then stretches band 20 until he is able to interconnect the attachment means 70. Once the connection between the opposing attachment means is secure, the user may insert his fingers into the finger loops 36 of the respective hand adapters 30. The user may then separate the connected attachment means 70 and grip an exercise device, surface, or free-weight with the bottom surfaces 37 of pads 32.

Figure 7A:
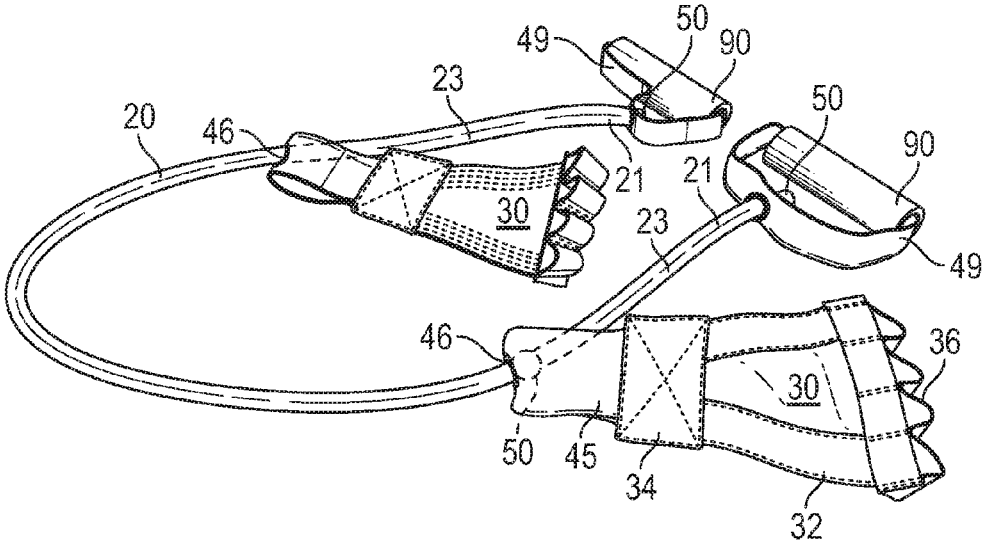
FIGS. 7A-7C show a resistance back strap device having a pair of hand adapters and further comprising a pair of handles coupled to terminal ends of the resistance band in accordance with a representative embodiment of the present invention.
Figure 7B:
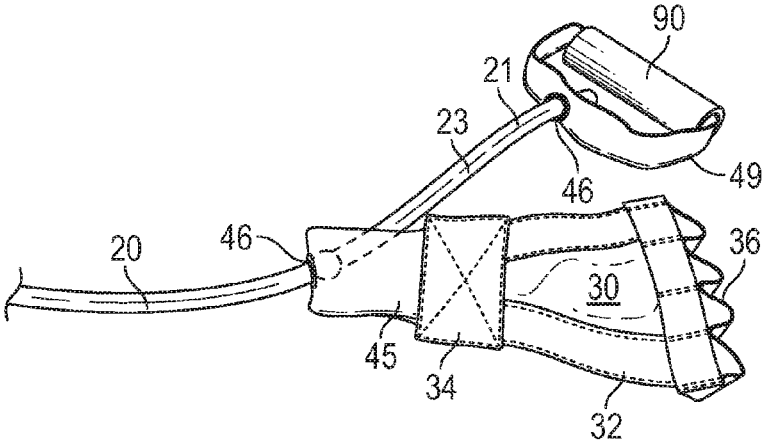
Figure 7C:
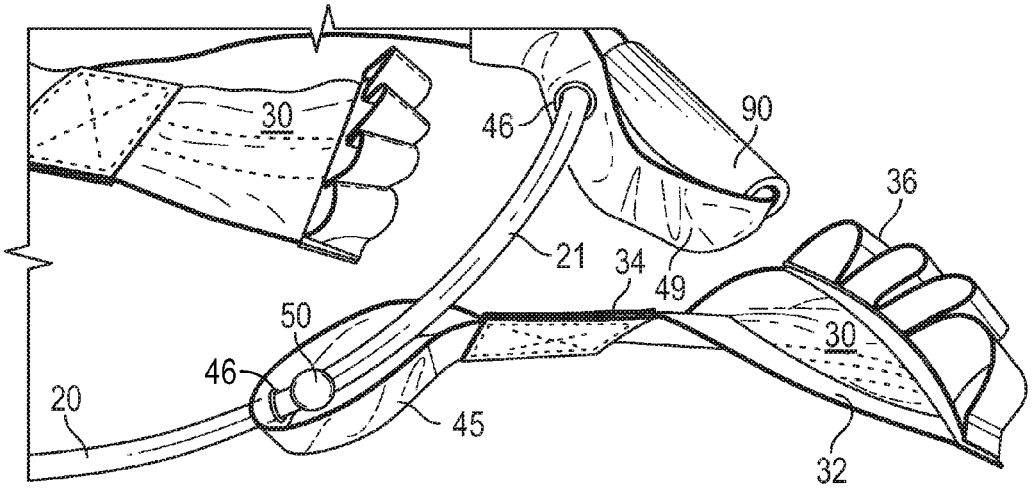

Referring now to FIGS. 7A-7C, some embodiments of the present invention further comprise a resistance band 20 having terminal ends 21 to which are attached a pair of handles 90. Handles 90 generally comprise a handgrip portion that is attached to terminal end 21 via an attachment loop 45. In some instances, loop 45 comprises an opening or grommet 46 through which terminal end 21 is threaded or inserted. Terminal end 21 further comprises a knot 50 or other similar structure to prevent removal of terminal end 21 from loop 45. In some instances, loop 45 comprises a continuous loop of nylon webbing that is inserted through a hollow core or interior of handle 90, such that handle 90 may rotate about loop 45. In other instance, loop 45 is securely fastened to terminal ends of handle 90.

Resistance band 20 further comprises a pair of hand adapters 30 which are coupled to resistance band 20 at locations between handles 90, such that an extension 23 is interposed between hand adapter 30 and handle 90. In some instances, hand adapters 90 are slidably positioned on resistance band 20 via opening or grommet 46. Resistance band 20 further comprises a knot 50 or other similar structure interposed between hand adapter 90 and extension 23, such that knot 50 prevents hand adapter 30 from sliding onto extension 23. In some instances, knot 50 comprises a rigid bead or similar structure having a maximum width that is greater than an interior diameter of resistance band 20, whereby the rigid bead is inserted within the interior space of resistance band 20 at a distance from terminal end 21, thereby defining extension 23. In some instances, knot 50 comprises a barb connector that attaches extensions 23 to the ends of resistance band 20, thereby attaching handles 90 to resistance band 20.

In some instances, extensions 23 comprise a length configured to accommodate holding handles 90 to perform a bicep curl, while the middle portion of resistance band 20 is secured beneath a user's feet in a standing position. Similarly, the distance between hand adapters 30 is configured to accommodate use of resistance band 20 in completing chest exercises, as discussed above. Thus, the present invention provides a single resistance band that may be used to perform a variety of exercise movements.

For example, in one embodiment the length of each extension 23 is approximately one-half the length of the section of resistance band interposed between the pair of hand adapters 30. In one embodiment, the length of the section of resistance band interposed between the pair of hand adapters 30 is approximately three-times the length of each extension 23. In some instances, the distance between hand adapters 30 may be adjusted by repositioning knot 50 located between hand adapters 30 and extensions 23. In some instances, handles 90 are selectively coupled to terminal ends 21 such that handles 90 may be interchanged with a separate gripping structure, such as pistol grip or knotted rope structure.

The present invention may be embodied in other specific forms without departing from its structures, methods, or other essential characteristics as broadly described herein and claimed hereinafter. The described embodiments are to be considered in all respects only as illustrative, and not resistive. The scope of the invention is, therefore, indicated by the appended claims, rather than by the foregoing description. All changes that come within the meaning and range of equivalency of the claims are to be embraced within their scope.

What is claimed is:

1. An exercise device, comprising:

a single resistance band having a first terminal end, a second terminal end, and a body interposed therebetween;

a first handle coupled to the first terminal end and a second handle coupled to the second terminal end;

a pair of hand adapters coupled to the body of the singular resistance band between the first and second handles, such that a first portion of the body is interposed between the first handle and the first hand adapter, and a second portion of the body is interposed between the second handle and the second hand adapter;

wherein the first and second hand adapters each comprise a plurality of finger loops configured to receive the second, third, fourth, and fifth phalanges of a user's hands.

2. The exercise device of claim 1, further comprising a third portion of the body interposed between the pair of hand adapters.

3. The exercise device of claim 2, wherein the third portion of the body comprises a length that is at least twice the length of the first or second portions of the body.

4. The exercise device of claim 1, wherein the first and second handles are removably coupled to the first and second terminal ends.

5. The exercise device of claim 4, further comprising a gripping structure that is interchangeably coupled to at least one of the first and second terminal ends.

6. The exercise device of claim 1, further comprising a first knot interposed between the first handle and a first proximal hand adapter of the pair of hand adapters, and a second knot interposed between the second handle and a second proximal hand adapter of the pair of hand adapters.

7. The exercise device of claim 1, further comprising a knot interposed between each handle and the respective terminal end.

8. The exercise device of claim 1, wherein a length of the first portion of the body is equal to a length of the second portion of the body.

9. The exercise device of claim 1, wherein the resistance band comprises an elastomeric material.

10. The exercise device of claim 1, wherein the plurality of finger loops comprises a fabric material.

11. The exercise device of claim 1, wherein the plurality of finger loops are configured to contact a back surface of the second, third, fourth and fifth phalanges of the user's hands, and a surface of the first or second hand adapters to which to the finger loops are attached is configured to contact a palm surface of the user's hand.

* * * * *